US005239345A

United States Patent [19]

Kikuchi et al.

[11] Patent Number: 5,239,345

[45] Date of Patent: Aug. 24, 1993

[54] IMAGE FORMING APPARATUS HAVING FUNCTION OF DUST REMOVAL

[75] Inventors: Hiroshi Kikuchi; Yoshiharu Momiyama; Yoshitomo Koga; Masato Sakai; Katsuyuki Ito; Shinichi Katakura, all of Tokyo, Japan

[73] Assignee: Oki Electric Industry Co., Ltd., Tokyo, Japan

[21] Appl. No.: 902,796

[22] Filed: Jun. 24, 1992

Related U.S. Application Data

[63] Continuation of Ser. No. 664,312, Mar. 4, 1991, abandoned.

[30] Foreign Application Priority Data

Mar. 6, 1990 [JP] Japan ..... 2-052698

[51] Int. Cl.[5] ..... G03G 15/06

[52] U.S. Cl. ..... 355/259; 118/652; 355/245

[58] Field of Search ..... 355/245, 215, 259, 208; 118/652

[56] References Cited

U.S. PATENT DOCUMENTS 4,267,245 5/1981 Wada ..... 118/652 X
4,271,784 6/1981 Ishimoto et al. ..... 118/652
4,398,817 8/1983 Nishimura et al. ..... 355/259 X
4,436,415 3/1984 Oka ..... 355/243 X
4,873,940 10/1989 Ishikawa et al. ..... 118/651

FOREIGN PATENT DOCUMENTS 0055372 4/1980 Japan .
55-121462A 9/1980 Japan .
60-11857A 1/1985 Japan .
0083761 4/1988 Japan .
1-62681A 3/1989 Japan .

*Primary Examiner*—A. T. Grimley
*Assistant Examiner*—Nestor R. Ramirez
*Attorney, Agent, or Firm*—Spencer, Frank & Schneider

[57] ABSTRACT

An image forming device for printing images on sheets of material includes a photosensitive member for carrying a latent image thereon, a developing roller rotatably disposed adjacent to the photosensitive member for supplying a layer of toner to the photosensitive member through rotation, and a developing blade adjustably disposed adjacent to the developing roller for regulating the thickness of the toner layer supplied to the photosensitive member. A driving circuit controllably rotates the developing roller, and a controller controls the driving circuit. The controller generates signals to control the driving circuit to reverse the rotation of the developing roller under certain conditions.

11 Claims, 4 Drawing Sheets

IMAGE FORMING APPARATUS HAVING FUNCTION OF DUST REMOVAL

This application is a continuation of application Ser. No. 07/664,312, filed Mar. 4, 1991 now abandoned.

BACKGROUND OF THE INVENTION

The present invention relates to an image forming apparatus used for a graphic type non-impact printer, and particularly to an image forming apparatus in which toner is fed to an electrostatic latent image bearing medium.

In general, an image forming apparatus in a graphic type non-impact printer is operated by a process comprising the steps of electric charge, exposure, development, transfer and fixation.

When a toner cartridge is set in the image forming apparatus, toner stored therein is dropped onto an agitating shaft and guide plate.

At this time, when a main motor is energized, a supply roller, a developing roller and a photosensitive drum which are engaged to a gear on the shaft of the main motor are rotated.

Toner is fed toward the supply roller from the agitating shaft through holes in a guide plate, and is then fed to the developing roller by the rotating supply roller. Toner sticking to the outer surface of the developing roller is turned into a thin layer by a developing blade, and is then fed toward the photosensitive drum. At this time, the toner is negatively charged. Meanwhile, the outer surface of the photosensitive drum is uniformly and negatively charged by a charger, and is then exposed to light by a printing head in accordance with image signals. Then, negative charge is released from a part which is exposed to the light. Accordingly, an electrostatic latent image corresponding to an image to be printed is formed by the part which is exposed to the light and the part which is not exposed to the light.

When the photosensitive drum is rotated so that the section on which the latent image is formed comes to a position where it faces the developing roller, it attracts the negatively charged toner so as to effect development. The image on the outer surface of the photosensitive drum is transferred from the latter to a sheet by the charger when the sheet passes between the photosensitive drum and the charger. The image obtained by the transfer of the toner image is thereafter is fixed by a fixing unit.

Further, the toner remaining on the outer surface of the photosensitive drum after the transfer is scraped off by a cleaning blade so as to stand by for the next printing. The toner scraped off is fed toward the agitating shaft by a screw shaft so as to be reused.

It is noted that the toner which has been retained in a retaining part is fluidized circulately by the supply roller and the developing roller which are rotated.

However, in the above-mentioned apparatus, with the repetitions of printing, paper dust from sheets sticks to the outer surface of the photosensitive drum, and is then mixed into the remaining toner after being scraped off by the cleaning blade. Since the remaining toner is reused, the paper dust mixed therein is also sent to the agitating shaft together with the toner. Further, when the toner on the developing roller is turned into a thin layer by the developing blade, the paper dust is caught between the developing roller and the developing blade, and accordingly, is sometimes held therebetween since it cannot pass. In such a case, the toner is scraped off from the developing roller by the paper dust held therebetween. Thus, there has been raised such a problem that the toner cannot be uniformly fed onto the photosensitive drum. That is, in this case, when an image is transferred onto a sheet, the part of the sheet onto which no toner is fed, is left as a white line. Further, such a white line is sustained until the paper dust is removed naturally.

Accordingly, one object of the present invention is to provide an image forming apparatus in which the rotation of a developing roller is periodically reversed so as to remove paper dust held between a developing roller and a cleaning blade.

SUMMARY OF THE INVENTION

The invention may comprise an image forming apparatus comprising: (a) a developing blade for regulating thickness of toner layer; (b) a developing roller for supplying toner onto photosensitive drum through rotation; (c) drive means for rotating said developing roller; and (d) control means for periodically controlling the drive means for reversing the rotation of the developing roller.

The invention may also comprise an image forming apparatus comprising a developing blade for regulating thickness of toner layer and a developing roller for supplying toner onto photosensitive drum through rotation comprising: (a) drive means for rotating the drive roller; (b) a timer for measuring predetermined time period from turning on the power source; and (c) control means for periodically controlling the drive means for reversing the rotation of the developing roller after a predetermined time period.

The invention may also comprise an image forming apparatus comprising a developing blade for regulating thickness of toner layer, a developing roller for supplying toner onto photosensitive drum through rotation comprising: (a) drive means for rotating the developing roller; (b) sheet detecting means for detecting a sheet and delivering a detection signal; (c) counter means for counting number of conveyed sheets with the detection signal; (d) first memory means for memorizing number of sheets counted by the counter means; (e) second memory means for storing a predetermined number of sheets; (f) comparator means for comparing the number of conveyed sheets with the predetermined number of sheets; and (g) control means for delivering instruction signals for reverse rotation to the drive means when the number of conveyed sheets gets equal to the predetermined number of sheets.

BRIEF DESCRIPTION OF THE DRAWINGS

FIG. 4 shows how FIGS. 4A and 4B relate; and

DETAILED DESCRIPTION OF THE PREFERRED EMBODIMENT

Figure 1:
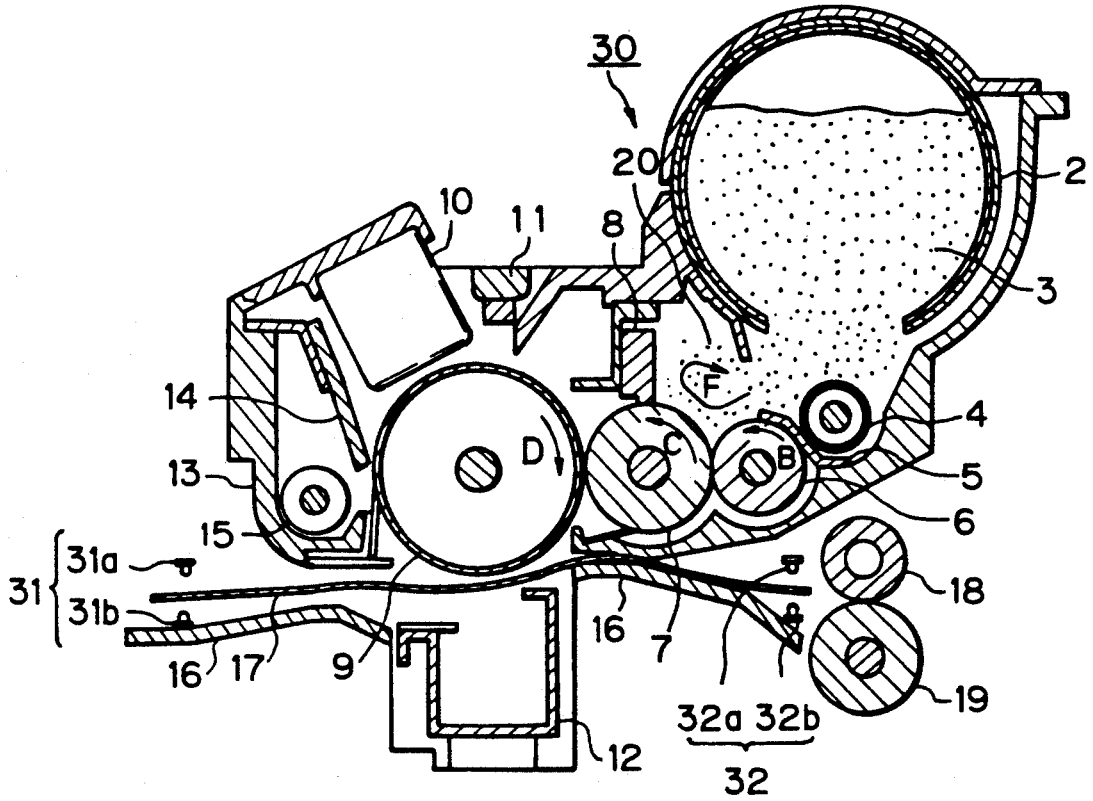
FIG. 1 is a sectional view illustrating an image forming apparatus.

Explanation will be made of an embodiment of an image forming apparatus according to the present invention, with reference to FIG. 1 which is a sectional view illustrating the image forming apparatus.

A toner cartridge 2 is set in the upper section of an apparatus 30. Toner 3 is filled in the toner cartridge 2. When the cartridge 2 is mounted and set in the apparatus 30, the toner 3 is discharged from the inside of the cartridge 2, and is fed into a developing section. After the toner 3 in the cartridge 2 has all been consumed, the cartridge 2 is replaced with a new one. An agitating shaft 4 is laid below the toner cartridge 2, and further, a supply roller 6 is disposed obliquely below the agitating shaft 4 with a guide plate 5 being laid therebetween. The agitating shaft 4 is constituted such that a wire is wound around a coiled shaft so that the toner 3 can be fed to the supply roller 6, uniformly in the axial direction. Several holes are formed in the guide plate 5 in order to regulate the volume of the toner 3 to be fed. Further, supply roller 6 is made of sponge and is adapted to supply the toner 3, a developing roller 7.

A developing blade 8 makes contact with the developing roller 7 with a predetermined pressure. The layer of toner 3 which is conveyed by the rotating developing roller 7, is regulated in its thickness since the developing blade 8 makes contact with the outer surface of the layer on developing roller 7. A photosensitive drum 9 as a latent image bearing medium is rotatably mounted making contact with the developing roller 7.

A charger 10, a printing head 11, a transfer unit 12 and a cleaning unit 13 are arranged surrounding around the photosensitive drum 9. The charger 10 is adapted to charge the outer surface of the photosensitive drum 9 uniformly thereover, and the printing head 11 irradiates light to the outer surface of the photosensitive drum 9 in accordance with an image signal. The transfer unit 12 is adapted to produce an electric charge having a polarity reverse to that of the charger 10 so as to transfer the toner 3 sticking to the outer surface of the photosensitive drum 9, to a sheet 17. Further, the cleaning unit 13 is attached thereto with a cleaning blade 14 and a screw shaft 15. The cleaning blade 14 is formed of a rubber material bonded to sheet metal, its free end making contact with the outer surface of the photosensitive drum 9 so as to serve to scrape off the toner 3 remaining on the outer surface of the photosensitive drum 9 after the transfer. The screw shaft 15 is constituted as a helical blade attached to a shaft, and is connected to the abovementioned agitating shaft 4 through the intermediary of another screw shaft inside of a side plate, which is not shown. That is, the toner 3 scraped off and trapped in the cleaning unit 13 is returned to the agitating shaft 4 so as to be reused.

Further, a guide 16 for conveying sheets is provided in the lower section of the apparatus 30, by which sheets 17 can pass between the photosensitive drum 9 and the transfer unit 12. The sheets 17 are conveyed by supply rollers 18, 19. Further, sensors 31, 32 are laid along the sheet conveying path so as to detect a number of the sheets 17. These sensors 31, 32 are composed of light emitting diodes 31*a*, 32*a* and light receiving diodes 31*b*, 32*b*, respectively.

Figure 2:
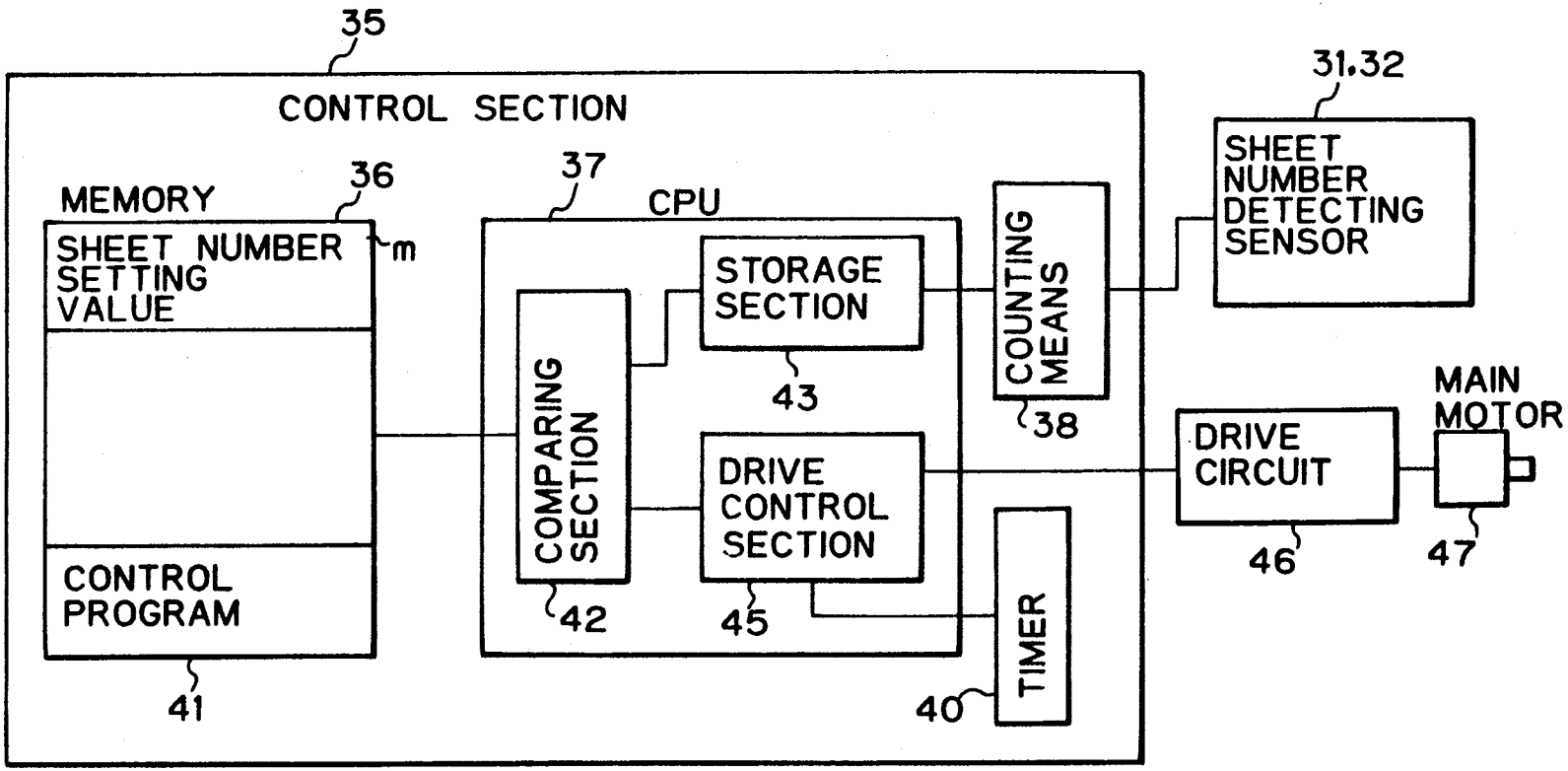
FIG. 2 is a block diagram illustrating an embodiment according to the present invention.

FIG. 2 shows a control section for controlling the drive of the image forming apparatus in this embodiment.

The control section 35 controls the image forming apparatus in its entirety, and includes a memory unit 36, a central processing unit (which will be hereinbelow denoted as CPU) 37, a counting means 38 and a timer 40.

The memory unit 36 is ROM (read only memory) in which a control program 41 for controlling the operation of the apparatus in its entirety is stored.

Further, a set value m of a predetermined number of sheets is stored in the memory unit 36. This set sheet number value m can be set, arbitrarily to, for example, 50, at the time of factory delivery. The memory unit 36 is connected to the CPU 37.

The CPU 37 conducts a computing process in accordance with the control program 41, and accordingly, it incorporates a comparing section 42, a storage section 43 and a drive control section 45. The comparing section 42 compares data stored in the storage section 43 with the set sheet number value m stored in the abovementioned memory unit 36.

The storage section 43 is connected to a counting means 38, and accordingly, it stores therein a result of counting by a counting means 38.

The drive control section 45 is connected to a drive circuit 46 so as to control the latter. The drive circuit 46 is adapted to drive a main motor for rotating the photosensitive drum 9, the developing roller 7 and the like in the image forming apparatus. That is, the drive control section 45 issues an instructing signal to the drive circuit 46 so as to normally and reversely rotate the main motor 47. The drive control section 45 is connected to the comparing section 42 so as to change the drive control for the main motor 47 in accordance with an output signal from the comparing section 42. Further, the drive control section 45 is connected to the timer 40.

The counting means 38 is connected to the sheet number detecting sensors 31, 32 attached to the sheet conveying path so as to count a number of printed sheets 17. The counting means 38 stores a result of counting in the storage section 43.

Figure 3:
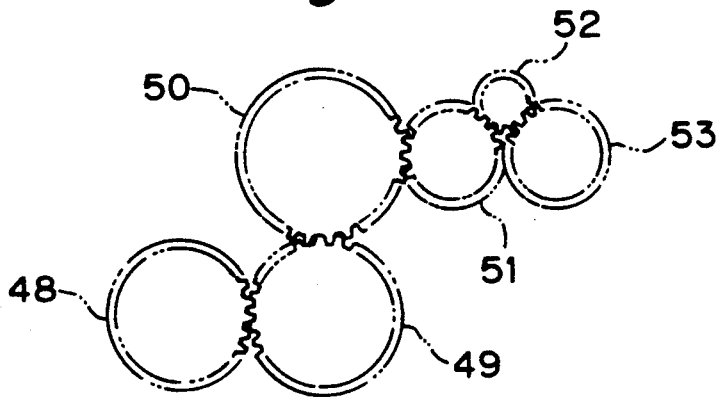
FIG. 3 is a view illustrating a gear train.

FIG. 3 is a view explaining a gear train. A main motor gear 48 is fitted on a shaft of the main motor 47 and is engaged with a photosensitive drum gear 50 through the intermediary of an idle gear 49. The photosensitive drum gear 50 is rotated integrally with the photosensitive drum 9, and is meshed with a developing roller gear 51. The developing roller gear 51 is rotated integrally with the developing roller 7, and is engaged with a supply roller gear 3 through the intermediary of an idle gear 52. The supply roller gear 53 is rotated integrally with the supply roller 6. As mentioned above, by rotating the main motor 47, the photosensitive drum 9, the developing roller 7 and the supply roller 4 can be rotated simultaneously.

Next, explanation will be hereinbelow made of operation of this embodiment with reference to FIGS. 4B which together form a flowchart explaining the operation of this embodiment.

Figure 4A:
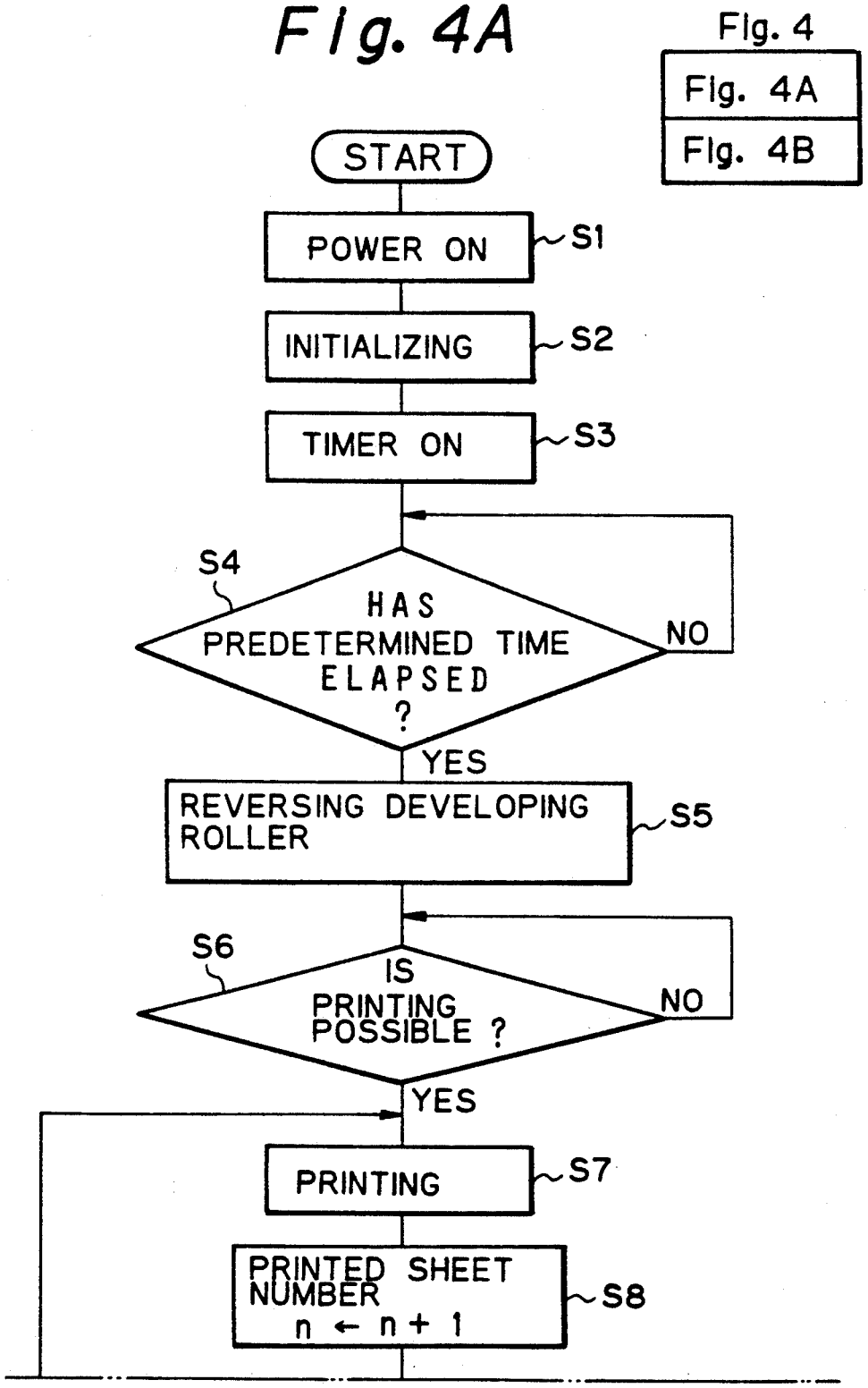
FIGS. 4A and 4B are a flow-chart showing the operation of the embodiment according to the present invention.

When a power source is turned on, as shown in FIG. 4A, (Step 1), the control section 35 is initialized (Step 2) while the image forming apparatus prepares for printing. The timer 40 in the control section 35 is energized (Step 3). The timer 40 measures a predetermined time after the power source has been turned on. However, this predetermined time is a few seconds, which is shorter than the time in which the preparation for printing is completed.

When the predetermined time elapses (Step 4), the timer 40 delivers a time elapse signal to the drive control section 45 in the CPU 37. The drive control section 45 delivers a signal for reversing the main motor 47 to the drive circuit 46. When the main motor 47 is reversed, the developing roller 7 is rotated in a direction reverse to the direction indicated by the arrow C (Step 5).

Explanation will be made of the operation of the reverse rotation of the developing roller 7 with reference to FIG. 1.

When the developing roller 7 is reversed, if dust such as paper dust or the like is held between the developing roller 7 and the developing blade 8, the dust can be carried away from a position therebetween. Or, even if the dust is not removed completely, it is slightly moved so that it is released from a held condition, and it is easier to remove. Since the toner 3 in the retaining section 20 is circulately fluidized, if the dust falls in such a condition that it can easily come away from the position between the developing roller 7 and the developing blade 8, the dust can be removed by the fluidization of the toner 3. As mentioned above, owing to the reverse rotation of the developing roller 7, the dust such as paper dust or the like held between the developing roller 7 and the developing blade 8 can be removed. It is noted here that a distance of movement by the reverse rotation of the developing roller 7 is few millimeters which is sufficient for removing the dust.

Again with reference to FIGS. 4A and 4B, the operation of the apparatus will be explained.

After the reverse rotation of the developing roller 7, whether the preparation for printing is completed or not is determined (Step 6). When the preparation for printing is completed, the operation of printing is carried out (Step 7). The printing operation is carried out in accordance with a series of steps of an image forming process for the sheets 17 one by one. Each time when a sheet is printed, the sheet number detecting sensors 31, 32 deliver detection signals to the counting means 38. The counting means 38 reads a set printed sheet number value previously stored in the storage section 43, and adds one to the value. The incremented value is then stored as a printed sheet number n in the storage section, 43 (Step 8).

Figure 4B:
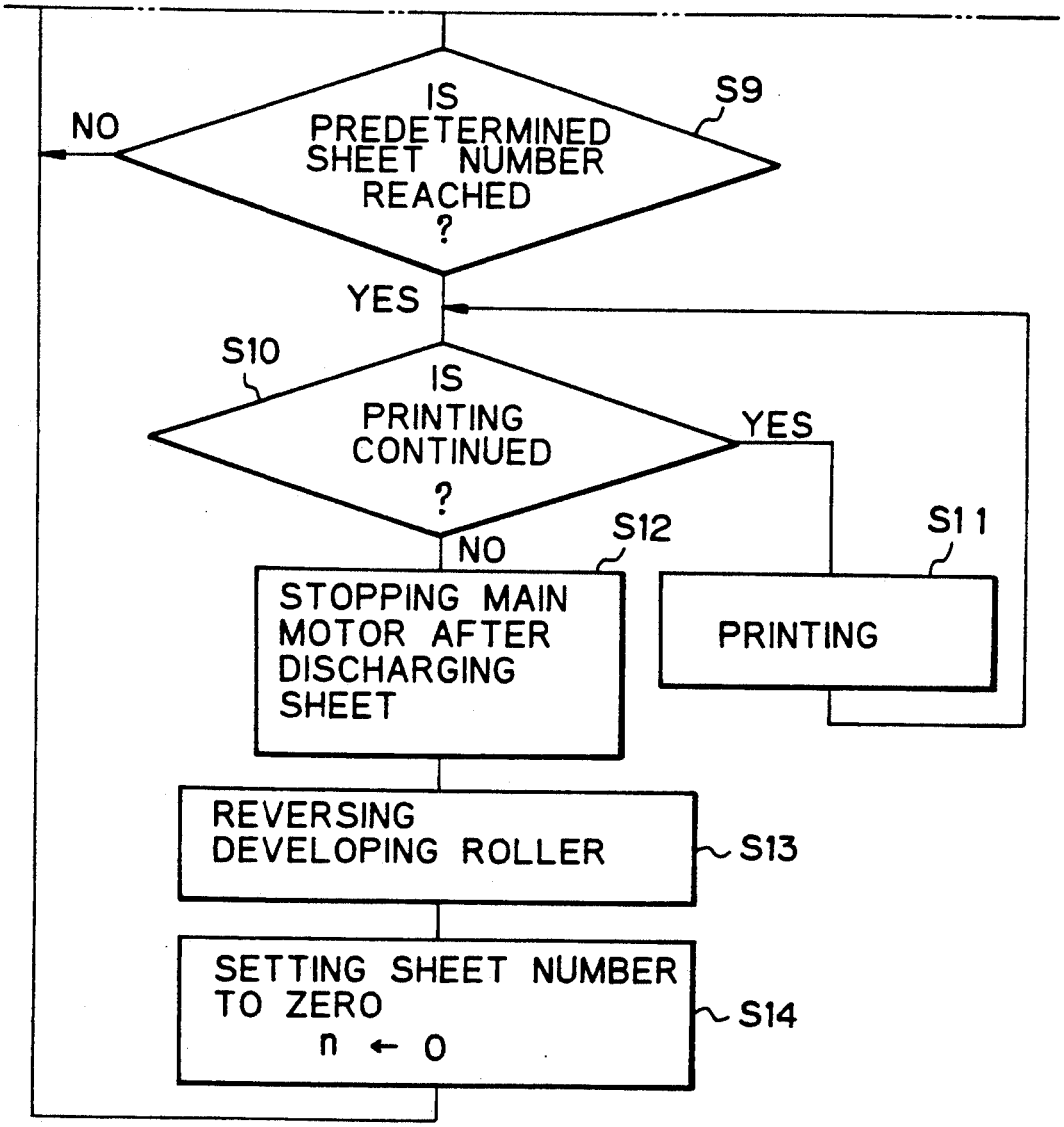

Then, referring now to FIG. 4B, the comparing section 42 in the CPU 37 reads the printed sheet number value n and the set printed sheet. number value m which are stored in the storage section 43 and memory 36 respectively, and compares them with each other (Step 9). If the printed sheet number value n reaches the set sheet number value m, the process is advanced to Step 10, but if it has not yet reached the value m, the process is returned to Step 7 so as to repeat the printing operation.

At Step 10, the CPU 37 determines whether a continued printing operation is being carried out at the present or not, and if so, the printing is continued (Step 11) to completion. At Step 10, if it is determined that continued printing is not being carried out, or of the contined printing is completed, the drive control section 45 shown in FIG. 2 delivers signal for stopping the main motor 47, to the drive circuit 46 (Step 12) after a printed sheet has been discharged. Thereafter, the drive control section 45 delivers signal for reversing the main motor 47, to the drive circuit 46 (Step 13). Accordingly, the developing roller 7 is reversed by gears 48, 49, 50, 51 shown in FIG. 3. The operation of this reverse rotation is similar to the operation at Step 5 mentioned above.

Owing to the reverse rotation of the developing roller 7 at this step, dust such as paper dust or the like which is newly caught between the developing roller 7 and the developing blade 8 after the power source has been turned on, can be removed. After the reverse rotation of the developing roller 7, the printed sheet number value n stored in the storage section 43 is reset to zero (Step 14).

As mentioned above, by periodically reversing the developing roller 7 after a predetermined time from the time of turn-on of the power source, and after a predetermined number of sheets has been printed, dust such as paper dust or the like caught between the developing roller 7 and the developing blade 8 can be removed. Further, in the above-mentioned embodiment, even though the predetermined number is reached during continuous printing, the printing is continued without interruption, and thereafter, the developing roller 7 is reversed. Accordingly, no extra printing time is required. Further, in the above-mentioned embodiment, it has been explained that the developing roller 7 is reversed in two ways. However, the developing roller can be, of course, reversed in either one of the two ways. The present invention should not be limited to the above-mentioned embodiment. That is, there may be considered for example, such an arrangement that a number of revolutions of the photosensitive drum 9 may be detected, and when this revolution number reaches a predetermined number, the developing roller can be reversed As detailed hereinabove, according to the present invention, the developing roller is periodically reversed so as to remove dust such as paper dust or the like caught between the developing roller and the developing blade, and thereby it is possible to eliminate a printing mistakes due to a lack of supply of toner on the photosensitive drum.

What we claim is:

1. An image forming apparatus for printing images on sheets of material comprising:

(a) a photosensitive member for carrying a latent image thereon;

(b) a developing roller rotatably disposed adjacent to said photosensitive member for supplying a layer of toner to the photosensitive member through rotation and a developing blade adjustably disposed adjacent to said developing roller for regulating the thickness of the toner layer supplied to the photosensitive member;

(c) drive means for controllably rotating said developing roller; and (d) control means for controlling said drive means to reverse rotate said developing roller before printing a first image each time the image forming apparatus is turned on, whereby by reverse rotating the developing roller before printing a first image after the image forming apparatus is turned on, any dust and other material which may have become caught between the developing roller and the developing blade is removed before printing of the first image.

2. An image forming apparatus as set forth in claim 1, wherein said control means further controls said drive means to reverse rotate said developing roller after a predetermined plurality of sheets have been printed on by said image forming apparatus, whereby by reverse rotating the developing roller after printing on a predetermined plurality of sheets, any dust and other material which may have become caught between the developing roller and the developing blade during printing of the plurality of sheets is removed before printing on further sheets is commenced.

3. An image forming apparatus for printing images on sheets of material comprising:

(a) a photosensitive member for carrying a latent image thereon;

(b) a developing roller rotatably disposed adjacent to said photosensitive member for carrying and supplying a layer of toner to the photosensitive member through rotation and a developing blade adjustably disposed adjacent to said developing roller for regulating the thickness of the toner layer supplied to the photosensitive member;

(c) drive means for controllably rotating said developing roller; and (d) control means for controlling said drive means, including means for generating instruction signals to control said drive means to reverse rotate said developing roller so that the developing roller is rotated in the reverse direction each time a predetermined plurality of sheets have been printed by said image forming apparatus.

4. An image forming apparatus for printing images on sheets of material comprising:

(a) a photosensitive member for carrying a latent image thereon;

(b) a developing roller rotatably disposed adjacent to said photosensitive member for supplying a layer of toner to the photosensitive member through rotation and a developing blade adjustably disposed adjacent to said developing roller for regulating the thickness of the toner layer supplied to the photosensitive member;

(c) drive means for controllably rotating said developing roller; and (d) control means for controlling said drive means, including means for generating instruction signals to control said drive means to reverse rotate said developing roller, the reverse rotation being performed a predetermined time after the image forming apparatus is turned on but before commencing printing of images;

wherein said control means further comprises means for counting the number of rotations of said photosensitive member and causing said means for generating to control said drive means to reverse rotate said developing roller when said photosensitive member has rotated a predetermined number of times.

5. An image forming apparatus for printing images on sheets of material comprising:

(a) a photosensitive member for carrying a latent image thereon;

(b) a developing roller rotatably disposed adjacent to said photosensitive member for carrying and supplying a layer of toner to the photosensitive member through rotation and a developing blade adjustably disposed adjacent to said developing roller for regulating the thickness of the toner layer supplied to the photosensitive member;

(c) drive means for controllably rotating said developing roller; and (d) control means for controlling said drive means, including means for generating instruction signals to control said drive means to reverse rotate said developing roller so that the developing roller is rotated in the reverse direction when a predetermined number of sheets has been printed by said image forming apparatus;

wherein said control means further comprises means for counting the number of sheets printed by said image forming apparatus and means for comparing the counted number with said predetermined number to cause said means for generating to control said drive means to reverse rotate said developing roller after said counted number exceeds said predetermined number.

6. An image forming apparatus for printing images on sheets of material conveyed through the apparatus comprising:

(a) a photosensitive member for carrying a latent image to be printed on the sheets with toner;

(b) a developing roller for carrying and depositing a layer of toner onto said photosensitive member, a developing blade for regulating the thickness of the toner layer and drive means for controllably rotating said developing roller;

(c) sheet detecting means for detecting a sheet being conveyed through the apparatus and generating a detection signal each time a sheet is detected;

(d) counter means for counting the number of sheets indicated by the detection signal and outputting a counted number;

(e) first memory means for storing the counted number output by the counter means;

(f) second memory means for prestoring a number representing a predetermined number of sheets;

(g) comparator mans for comparing the counted number with the prestored number; and (h) control means for generating reverse rotation control signals to the drive means to reverse rotate the developing roller for a period of time when the counted number equals the prestored number.

7. An image forming apparatus as set forth in claim 6, wherein the control means includes means for resetting the counted number stored in said first memory means to zero after the reverse rotation is completed.

8. An image forming apparatus as set forth in claim 6, wherein said control means further comprises means for determining if continuous printing is being performed by the apparatus and delaying the reverse rotation control signals until completion of the continuous printing is determined.

9. In an image forming apparatus for printing images on sheets conveyed therethrough having a developing roller for delivering toner to a photosensitive member, a developing blade for adjusting the amount of toner delivered by the developing roller, and control means for controlling the rotation of the developing roller, a method comprising the steps of:

determining how much time has elapsed since the apparatus was turned on;

detecting if said elapsed time equals a predetermined time; and rotating the developing roller a in the reverse direction before the first printing starts when said elapsed time equals said predetermined time.

10. The method of claim 9, further comprising the steps of:

counting the number of sheets conveyed through the apparatus during a plurality of successive printings;

detecting if the counted number of sheets conveyed equals a predetermined number; and reverse rotating the developing roller when said number of sheets conveyed equals said predetermined number.

11. In an image forming apparatus for printing images on sheets conveyed therethrough having a developing roller for delivering toner to a photosensitive member, a developing blade for adjusting the amount of toner delivered by the developing roller, and control means for controlling the rotation of the developing roller, a method comprising the steps of:

determining how much time has elapsed since the apparatus was turned on;

detecting if said elapsed time equals a predetermined time;

rotating the developing roller in the reverse direction before the first printing starts when said elapsed time equals said predetermined time;

counting the number of sheets conveyed through the apparatus during printing;

when a predetermined number of sheets have been counted, detecting if continuous printing is being performed;

immediately reverse rotating the developing roller if continuous printing is not detected; and reverse rotating the developing roller after continuous printing is completed if continuous printing is detected.

* * * * *